US009562417B2

(12) United States Patent
Idland

(10) Patent No.: US 9,562,417 B2
(45) Date of Patent: Feb. 7, 2017

(54) SEALING DEVICE FOR WELL COMPONENTS

(75) Inventor: Svein Arne Idland, Algard (NO)

(73) Assignee: International Research Institute of Stavanger AS, Stavanger (NO)

( * ) Notice: Subject to any disclaimer, the term of this patent is extended or adjusted under 35 U.S.C. 154(b) by 199 days.

(21) Appl. No.: 14/239,091

(22) PCT Filed: Aug. 22, 2012

(86) PCT No.: PCT/NO2012/050151

§ 371 (c)(1),
(2), (4) Date: Mar. 18, 2014

(87) PCT Pub. No.: WO2013/028079

PCT Pub. Date: Feb. 28, 2013

(65) Prior Publication Data

US 2015/0167421 A1 Jun. 18, 2015

(30) Foreign Application Priority Data

Aug. 25, 2011 (NO) ..... 20111158

(51) Int. Cl.
*E21B 33/13* (2006.01)
*E21B 33/12* (2006.01)
*E21B 33/128* (2006.01)

(52) U.S. Cl.
CPC ..... *E21B 33/13* (2013.01); *E21B 33/1208* (2013.01); *E21B 33/1285* (2013.01)

(58) Field of Classification Search
USPC ..... 277/327, 328, 332, 337
See application file for complete search history.

(56) References Cited

U.S. PATENT DOCUMENTS 5,857,520 A * 1/1999 Mullen ..... E21B 33/1216 166/179
2002/0121743 A1 9/2002 Crow et al.
(Continued)

FOREIGN PATENT DOCUMENTS

WO 9305267 3/1993

OTHER PUBLICATIONS

International Preliminary Report on Patentability for PCT/NO2012/050151 dated Jun. 11, 2013.
(Continued)

*Primary Examiner* — Jennifer H Gay
*Assistant Examiner* — Caroline Butcher
(74) *Attorney, Agent, or Firm* — Andrus Intellectual Property Law, LLP

(57) ABSTRACT

A sealing device is for sealing fluid transmittable openings in well components. The sealing device includes an elastic element which is arranged between two shoulders. The elastic element, before being placed in the fluid transmittable opening, has a larger external dimension than the fluid transmittable opening to be sealed. A gap is arranged between at least one of the shoulders and the elastic element, allowing liquid to enter between the shoulder and the elastic element. The ridge is arranged on an intermediate piece which is located between the shoulder and the elastic element. The intermediate piece is constituted by as ring in which the ridge is surrounding and divided, and projects from an end surface opposite an abutment surface facing the elastic element.

3 Claims, 3 Drawing Sheets

(56) References Cited

U.S. PATENT DOCUMENTS

| | | | | |
|---|---|---|---|---|
| 2005/0161232 | A1 | 7/2005 | Patel et al. | |
| 2006/0027378 | A1 | 2/2006 | Zimmermann | |
| 2007/0235182 | A1 | 10/2007 | Artherholt | |
| 2009/0242215 | A1 | 10/2009 | Eatwell et al. | |
| 2012/0205872 | A1* | 8/2012 | Reinhardt ..... | E21B 33/1208 277/336 |

OTHER PUBLICATIONS

International Search Report and Written Opinion for PCT/NO2012/050151 dated Jun. 11, 2013.

* cited by examiner

I-I

SEALING DEVICE FOR WELL COMPONENTS

CROSS-REFERENCE TO RELATED APPLICATIONS

This application is the U.S. national stage application of International Application PCT/NO2012/050151, filed Aug. 22, 2012, which international application was published on Feb. 28, 2013, as International Publication WO2013/028079 in the English language. The International Application claims priority of Norwegian Patent Application 20111158, filed Aug. 25, 2011. The international application and Norwegian patent application are fully incorporated herein by reference.

FIELD

This invention relates to a seal for well components. More particularly, it relates to a seal for sealing fluid transmittable openings in well components, the seal including an elastic element which is arranged between two shoulders, and the elastic element, before being placed in the fluid transmittable opening, having a larger external dimension than the fluid transmittable opening to be sealed.

BACKGROUND

When sealing fluid transmittable openings in a well, such as in a petroleum well, it is usual to move a seal having an elastic element of a larger external diameter than the diameter of the fluid transmittable opening to be sealed, into the fluid transmittable opening. By the elastic element being arranged between two shoulders, the volume that the elastic element may occupy is restricted, whereby a greater surface pressure is achieved between the elastic element and the inner jacket of the fluid transmittable opening, as compared to if the elastic element could lengthen freely.

During operation, damage may occur in the sealing surface of well components. For example, during wireline operations in the well, it is not unusual for one or more axial grooves to be worn into the sealing surface of a downhole safety valve. Other causes may cause other types of damage in the sealing surfaces.

Known seals often cannot be brought to seal damaged fluid transmittable openings. The reason is that the damage is not filled by the elastic element and thereby sufficient sealing of the damage for a differential pressure to be established across the elastic element is not achieved.

As known seals notoriously provide an unreliable seal, it is usual to place a seal outside the damaged sealing surface. Seals of this kind may be functionally unreliable, which has turned out to possibly result in operational interruptions and need for repairs.

SUMMARY

The invention has for its object to remedy or reduce at least one of the drawbacks of the prior art.

The object is achieved according to the invention through the features which are specified in the description below and in the claims that follow.

A seal is provided for sealing fluid transmittable openings in well components, the seal including an elastic element which is arranged between two shoulders, and the elastic element, before being placed in the fluid transmittable opening, having a larger external dimension than the fluid transmittable opening to be sealed, and where the seal has a gap being formed between at least one of the shoulders and the elastic element, allowing liquid to enter between the shoulder and the elastic element, wherein the gap is arranged in an intermediate piece located between the shoulder and the elastic element, and where the intermediate piece is constituted by a ring, in which a surrounding divided ridge is arranged to rest against the shoulder.

By liquid being able to enter the gap, a hydraulic axial force is imparted to the elastic element, contributing to further increasing the surface pressure from the elastic element against the sealing surface of the fluid transmittable opening. The elastic material thereby penetrates deeper into a groove in the sealing surface, for example. Thereby the leakage through the groove is reduced, whereby the differential pressure across the elastic element increases further and the elastic element fills the groove and enables the establishment of full differential pressure across the seal.

The ridge prevents the ring from closing a gap between the ring and the shoulder, while, at the same time, liquid may penetrate past the ridge to the part of the gap that is located behind the ridge.

The abutment surface of the ring towards the elastic element may be conical. A conical shape has proved appropriate in order to achieve a good seal.

It may be advantageous for there to be an adapted clearance between the ring and the shoulder before insertion a the seal in an fluid transmittable opening, to facilitate the insertion of the seal.

The device according to the invention solves a long-felt problem in a mechanically simple way, and the seal may be set and activated without complicated procedures having to be followed.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figures 1, 1A:
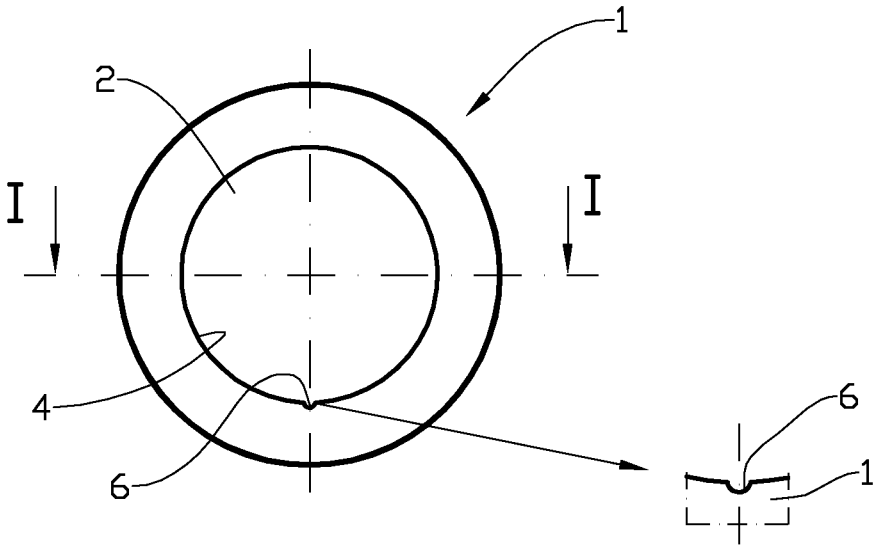
FIG. 1 shows an end view of a damaged well component, a groove having been worn into the sealing surface of the well component.
FIG. 1*a* shows a section, on a larger scale, of the damage as shown in FIG. 1.
Figure 2:
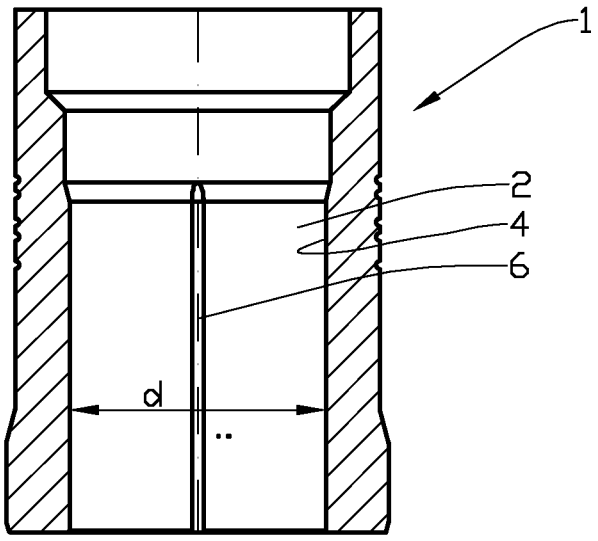
FIG. 2 shows a section I-I of FIG. 1.
Figure 3:
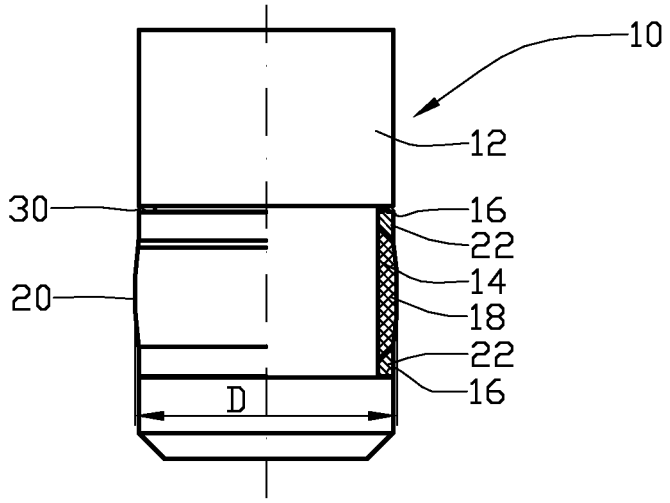
FIG. 3 shows a side view, partially in section, of a seal according to the invention.
Figure 4:
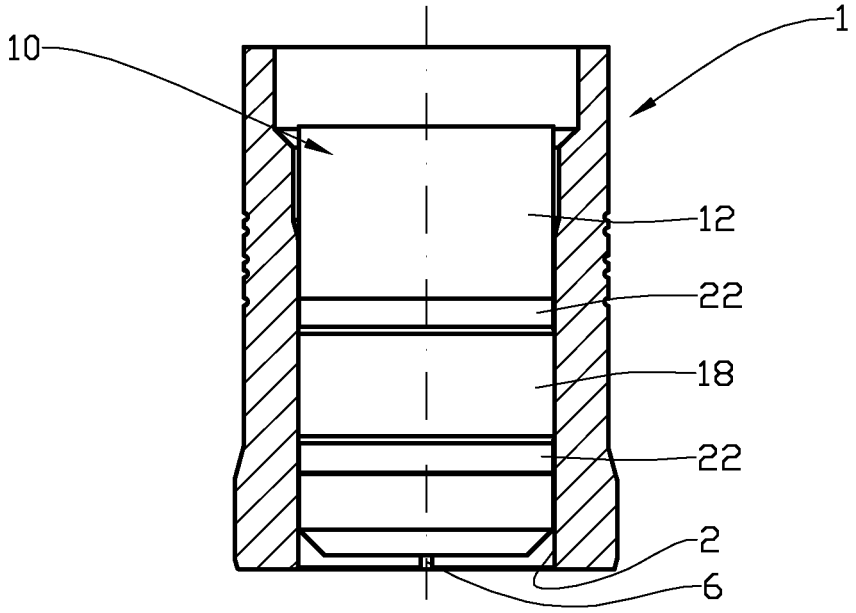
FIG. 4 shows the seal as shown in FIG. 3 after it has been placed in the well component.

In the drawings, the reference numeral 1 indicates a well component which is formed with a fluid transmittable through opening 2 with a sealing surface 4, damage in the form of a groove 6 having been inflicted on the sealing surface 4. The groove 6 is shown in FIG. 2 as well. The fluid transmittable opening 2 has an internal diameter d.

A seal 10 includes a cylindrical seal mount 12 which is formed with a turned-down portion 14, in which shoulders 16 are formed. The seal mount 12 is movable into the fluid transmittable opening 2 of the well component 1.

An elastic element 18 is placed in and tightly surrounds the portion 14. Externally, the elastic element 18 has been given a convex surface 20 which is arranged to seal against the sealing surface 4. The convex surface 20 has a largest diameter D which is larger than the internal diameter d of the fluid transmittable opening 2.

Figure 5:
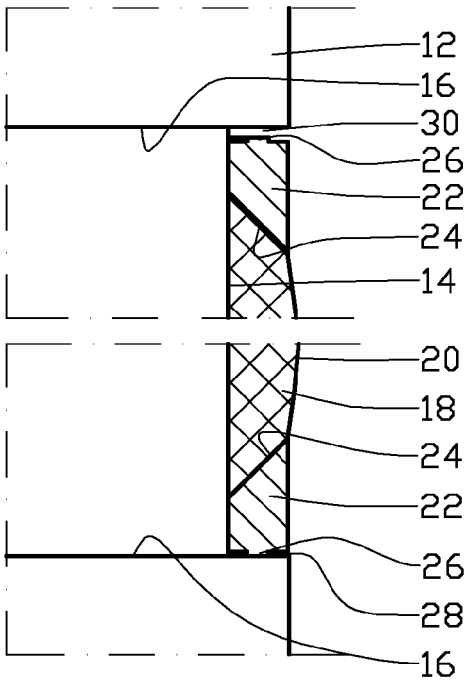
FIG. 5 shows a section, on a larger scale, of the seal prior to activation.
Figure 6:
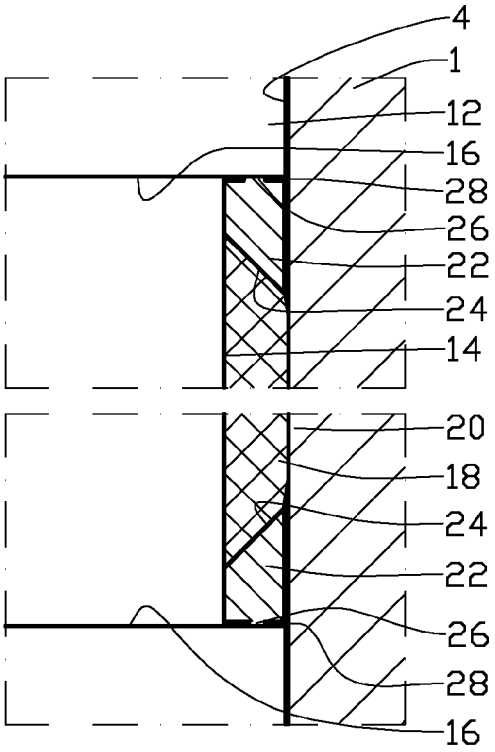
FIG. 6 shows the same as FIG. 5, but after the seal has been placed in the well component.
Figure 7:
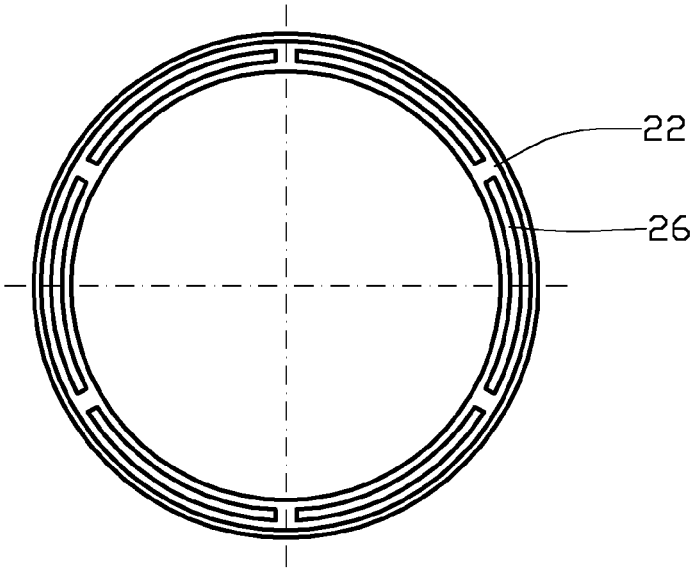
FIG. 7 shows an end view of a ring with a divided surrounding ridge.

At either end portion of the elastic element 18, an intermediate piece 22 in the form of a ring is arranged, which is formed with a conical surface 24 towards the elastic element 18. On the opposite side, the ring 22 is provided with a surrounding, divided ridge 26, see FIGS. 5-7. The ridge 26 provides for there always to be a gap 28 between a substantial portion of the ring 22 and the corresponding shoulder 16.

The total length of the elastic element 18 and the rings 22 is normally equal to or smaller than the length of the portion 14 when the seal 10 is in the non-activated state. Thus, there may be a distance 30 between at least one of the rings 22 and the corresponding shoulder 16, see FIG. 5. The purpose of this distance 30, when present, is to facilitate the insertion of the seal 10 in the fluid transmittable opening 2.

As the seal 10 is moved into the fluid transmittable opening 2, the elastic element 18 is resting against the sealing surface 4. Since the sealing surface 4 has a smaller diameter d than the free external diameter D of the elastic element, the external diameter of the elastic element is reduced, which has the effect of the length of the elastic element 18 being increased until both rings 22 abut against their respective shoulders 16, see FIG. 6. In a manner known per se, a larger surface pressure is thereby built up between the elastic element 18 and the sealing surface 4.

However, this surface pressure is not sufficient to force the material of the elastic element 18 to the bottom in the groove 6. Because of the relatively modest cross section of the groove 6, a minor differential pressure is still built up across the elastic element 18. The pressure from the surroundings enters the gaps 28, working there as a hydraulic force against the rings 22 which are thereby moved in the direction of the elastic element 18. The elastic element 18 is compressed further, and the groove 6 is sealed by the elastic element 18 so that full differential pressure may be built up across the seal 10. Practical tests show that if the distance 30 is too large, the elastic element 18 will not be forced to the bottom inside the groove 6.

The invention claimed is:

1. A sealing device for sealing a sealing surface of a fluid transmittable opening in well components, the sealing device comprising an elastic element which is configured between two shoulders fixed on a turned-down portion of a seal mount configured to be received in the fluid transmittable opening, and the elastic element, before being placed in the fluid transmittable opening, having a larger external diameter than an internal diameter of the fluid transmittable opening to be sealed such that the elastic element seals against the sealing surface with a first surface pressure when the seal mount is received within the fluid transmittable opening, and where between at least one of the shoulders and the elastic element, a gap is formed by a ridge which abuts against the shoulder and which allows liquid to enter the gap between the shoulder and the elastic element, wherein the ridge is arranged on an intermediate piece which is located between the shoulder and the elastic element, and where the intermediate piece is constituted by a ring wherein the ridge is divided into segments, extends circumferentially within the ring, and projects from an end surface of the ring opposite an abutment surface facing the elastic element, wherein, in response to fluid pressure from the liquid entering the gap, the ring is configured to move axially along the turned-down portion toward the elastic element so that the elastic element exerts a second surface pressure increased relative to the first surface pressure against the sealing surface.

2. The device in accordance with claim 1, wherein the abutment surface of the intermediate piece facing towards the elastic element is conical.

3. The device in accordance with claim 1, wherein between the intermediate piece and the shoulder, there is a distance prior to insertion of the sealing device in the fluid transmittable opening.

* * * * *